US009746267B2

(12) United States Patent
Smith

(10) Patent No.: US 9,746,267 B2
(45) Date of Patent: Aug. 29, 2017

(54) MODULAR SILENCER

(71) Applicant: RA Brands, L.L.C., Madison, NC (US)

(72) Inventor: Michael Leighton Smith, Alpharetta, GA (US)

(73) Assignee: R A Brands, L.L.C., Madison, NC (US)

( * ) Notice: Subject to any disclaimer, the term of this patent is extended or adjusted under 35 U.S.C. 154(b) by 0 days.

(21) Appl. No.: 14/994,592

(22) Filed: Jan. 13, 2016

(65) Prior Publication Data

US 2016/0209151 A1 Jul. 21, 2016

Related U.S. Application Data

(60) Provisional application No. 62/104,114, filed on Jan. 16, 2015.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36; F41A 21/38; F01N 1/003
USPC ..... 89/14.2, 14.3, 14.5; 42/1.06; 181/223
See application file for complete search history.

(56) References Cited

U.S. PATENT DOCUMENTS 1,021,742 A 3/1912 Moore
1,111,202 A 9/1914 Westfall
1,259,251 A 3/1918 Love
1,342,978 A 12/1919 Young
1,427,802 A 9/1922 Goodwin
1,667,186 A 4/1928 Bluehdorn
1,770,471 A 7/1930 Hatcher
2,315,207 A 3/1943 Frantisek et al.
2,503,491 A 4/1950 Janz
(Continued)

FOREIGN PATENT DOCUMENTS

AU 198430045 A 1/1986
AU 2009201323 A1 10/2009
(Continued)

OTHER PUBLICATIONS

Element PBS-1 Silencer for AK Series (https://raid-airsoft.com/2014/02/24/element-pbs-1-silencer-for-ak-series/) R.A.I.D. Raid-Airsoft, printed date Jun. 10, 2016.

*Primary Examiner* — Bret Hayes
(74) *Attorney, Agent, or Firm* — Womble Carlyle Sandridge & Rice LLP

(57) ABSTRACT

A modular noise suppressor for a firearm may have rearward and forward sections, and a front end cap. The rearward section may contain one or more baffles and can be configured to connect to the barrel of the firearm. The forward section can contain one or more baffles and may be connected to the rearward section. The front end cap can be connected to the forward section and provide a force to the baffles of the forward section. The connection between the rearward and forward sections can be in axial tension at least in response to the front end cap providing the force to the baffles of the forward section such that any loosening of the connection between the rearward and forward sections can be at least partially restricted in response to the axial tension.

11 Claims, 10 Drawing Sheets

(56) References Cited

U.S. PATENT DOCUMENTS 2,514,996 A 7/1950 Faust, Jr.
2,792,760 A 5/1957 Hammer
3,164,060 A 1/1965 Dahl
3,500,955 A * 3/1970 Werbell ..... F41A 21/30 181/223
3,667,570 A 6/1972 WerBell, III
3,786,895 A 1/1974 Perrine
4,510,843 A 4/1985 Rabatin
4,576,083 A 3/1986 Seberger, Jr.
4,588,043 A 5/1986 Finn
4,679,597 A 7/1987 Stein
4,907,488 A 3/1990 Seberger
4,974,489 A 12/1990 Fishbaugh
5,029,512 A 7/1991 Latka
5,164,535 A * 11/1992 Leasure ..... F41A 21/30 181/223
5,611,409 A 3/1997 Arseneau
5,679,916 A * 10/1997 Weichert ..... F41A 21/30 181/223
6,079,311 A 6/2000 O'Quinn et al.
6,374,718 B1 4/2002 Rescigno et al.
6,575,074 B1 6/2003 Gaddini
6,595,099 B1 7/2003 Olson et al.
6,796,214 B2 9/2004 Hausken et al.
6,796,403 B1 9/2004 Laughlin
6,848,538 B2 2/2005 Shafer
7,073,426 B1 7/2006 White
7,237,467 B1 7/2007 Melton
7,308,967 B1 12/2007 Hoel
7,412,917 B2 8/2008 Vais
7,516,690 B2 4/2009 McClellan
7,600,606 B2 10/2009 Brittingham
7,610,992 B2 11/2009 Brittingham
7,789,008 B2 9/2010 Petersen
7,832,323 B1 11/2010 Davies
7,856,914 B2 12/2010 Shults et al.
7,905,171 B1 3/2011 Brittingham
7,931,118 B1 4/2011 Cronhelm
7,987,944 B1 8/2011 Brittingham et al.
8,096,222 B2 1/2012 Silvers
8,100,224 B1 1/2012 Olson
8,104,570 B2 1/2012 Miller et al.
D657,012 S 4/2012 Woodell
8,162,100 B2 4/2012 Shults et al.
8,167,084 B1 5/2012 Moore
8,171,840 B2 5/2012 Kline et al.
8,292,025 B1 10/2012 Woodell et al.
8,307,946 B1 11/2012 Johnston
8,424,441 B2 4/2013 Brittingham et al.
8,424,635 B1 4/2013 Klawnn
8,439,155 B2 5/2013 Shults
8,453,789 B1 6/2013 Honigmann et al.
D685,874 S 7/2013 Andrews, Jr. et al.
8,474,361 B2 7/2013 Brittingham
8,479,632 B2 7/2013 Kline et al.
8,490,535 B1 7/2013 Moore et al.
8,505,431 B2 8/2013 Hines
8,511,425 B2 8/2013 Larue
8,516,941 B1 * 8/2013 Oliver ..... F41A 21/30 181/223
8,528,691 B1 9/2013 Carmichael et al.
8,567,556 B2 10/2013 Dueck et al.
8,579,075 B2 11/2013 Brittingham et al.
8,584,794 B2 11/2013 Dueck
8,714,301 B2 5/2014 Shults
8,739,922 B2 6/2014 Wirth et al.
8,770,084 B2 7/2014 Young
8,807,272 B2 8/2014 Bladen
8,820,473 B1 9/2014 White
8,833,512 B2 9/2014 Smith et al.
8,910,745 B2 12/2014 Latka
8,910,746 B1 12/2014 McKenzie
8,950,310 B2 2/2015 Storrs et al.
8,950,546 B2 2/2015 Shults
8,973,481 B2 3/2015 Dueck et al.
8,978,818 B2 3/2015 Proske
8,991,550 B2 3/2015 Coley
8,991,552 B2 3/2015 Latka
9,038,770 B1 5/2015 Morrison
9,038,771 B1 5/2015 Mueller
9,046,316 B1 6/2015 Young
9,086,248 B2 7/2015 Young et al.
9,091,502 B1 7/2015 Morrison
9,097,482 B1 8/2015 Holden et al.
9,102,010 B2 8/2015 Wilson
9,103,618 B2 8/2015 Daniel et al.
9,115,949 B1 8/2015 Morrison
9,115,950 B2 8/2015 Bethlenfalvy
9,121,656 B1 9/2015 McKenzie
9,194,640 B2 11/2015 Wirth et al.
9,207,033 B2 12/2015 Vais
9,261,317 B2 2/2016 Daniel et al.
9,322,607 B1 4/2016 Lau
9,328,984 B2 5/2016 Shults et al.
9,347,727 B1 5/2016 Cler
9,366,495 B1 * 6/2016 Coppinger ..... F41A 21/30
9,506,710 B2 * 11/2016 Smith ..... F41A 21/30
2004/0173403 A1 9/2004 Shafer
2006/0123983 A1 6/2006 Vais
2007/0107590 A1 5/2007 Silvers
2009/0139795 A1 6/2009 Brittingham
2010/0180759 A1 7/2010 Petersen
2010/0218671 A1 9/2010 Mayberry et al.
2011/0056111 A1 3/2011 Brittingham
2011/0067950 A1 3/2011 Shults et al.
2011/0132683 A1 6/2011 Miller et al.
2011/0174141 A1 7/2011 Adolphsen
2011/0220434 A1 9/2011 Silvers
2011/0297477 A1 12/2011 Koumbis
2012/0048644 A1 3/2012 Kline et al.
2012/0080261 A1 4/2012 Shand
2012/0145478 A1 6/2012 Brittingham
2012/0152093 A1 6/2012 Koumbis
2012/0152649 A1 6/2012 Larue
2012/0167749 A1 7/2012 Young
2012/0180624 A1 7/2012 Troy et al.
2012/0199415 A1 8/2012 Shults et al.
2012/0255807 A1 10/2012 Pieratti
2013/0168181 A1 7/2013 Wirth et al.
2013/0175113 A1 7/2013 Hines
2013/0180796 A1 7/2013 Dueck et al.
2013/0199071 A1 8/2013 Lee
2013/0312592 A1 11/2013 Storrs et al.
2013/0319790 A1 12/2013 Bladen
2014/0020976 A1 1/2014 Shults
2014/0076658 A1 3/2014 Smith, II et al.
2014/0157640 A1 6/2014 Whelan
2014/0158459 A1 6/2014 Shults et al.
2014/0190345 A1 7/2014 Daniel et al.
2014/0224575 A1 8/2014 Latka
2014/0231168 A1 8/2014 Dueck et al.
2014/0262602 A1 * 9/2014 Moss ..... F41A 21/30 181/211
2014/0262604 A1 9/2014 Proske
2014/0299405 A1 10/2014 Miller et al.
2014/0318887 A1 10/2014 Latka
2014/0374189 A1 12/2014 Young et al.
2015/0090105 A1 4/2015 Pace
2015/0226506 A1 8/2015 Shults et al.
2015/0241159 A1 * 8/2015 Michal ..... F41A 21/44 89/14.4
2015/0260472 A1 9/2015 Smith
2015/0260473 A1 9/2015 Barney
2015/0267986 A1 9/2015 Sellars
2015/0276340 A1 10/2015 Vais
2015/0285575 A1 10/2015 Sclafani
2015/0292829 A1 10/2015 Pietila
2015/0323276 A1 11/2015 Myers et al.
2015/0338183 A1 11/2015 Salvador
2016/0018179 A1 1/2016 Morris et al.
2016/0061551 A1 3/2016 Petersen
2016/0076844 A1 3/2016 Miller, III

(56) References Cited

U.S. PATENT DOCUMENTS

| | | | |
|---|---|---|---|
| 2016/0084602 | A1 | 3/2016 | Smith |
| 2016/0109205 | A1 | 4/2016 | Coppinger et al. |

FOREIGN PATENT DOCUMENTS

| | | | |
|---|---|---|---|
| EP | 166802 | A1 | 1/1986 |
| EP | 2977708 | A1 | 1/2016 |
| GB | 426575 | A | 4/1935 |
| GB | 579168 | A | 7/1946 |
| GB | 614464 | A | 12/1948 |
| GB | 966934 | A | 8/1964 |
| GB | 2104197 | A | 3/1983 |
| GB | 2281119 | A | 2/1995 |
| GB | 2529462 | A | 2/2016 |
| WO | WO 2008-147446 | A2 | 12/2008 |
| WO | WO 2009-139803 | A2 | 11/2009 |
| WO | WO 2012-045119 | A1 | 4/2012 |
| WO | WO 2013-109655 | A1 | 7/2013 |
| WO | WO 2014-076356 | A1 | 5/2014 |
| WO | WO 2014-076357 | A1 | 5/2014 |
| WO | WO 2015-048127 | A1 | 4/2015 |

* cited by examiner

MODULAR SILENCER

CROSS REFERENCE TO RELATED APPLICATIONS

The present Patent Application is a formalization of previously filed, co-pending U.S. Provisional Patent Application Ser. No. 62/104,114, filed Jan. 16, 2015 by the inventor named in the present Application. This Patent Application claims the benefit of the filing date of this cited Provisional Patent Application according to the statutes and rules governing provisional patent applications, particularly 35 U.S.C. §119(e), and 37 C.F.R. §§1.78(a)(3) and 1.78(a)(4). The specification and drawings of the Provisional Patent Application referenced above are specifically incorporated herein by reference as if set forth in their entirety.

TECHNICAL FIELD

The present disclosure generally relates to silencers or noise suppressor for firearms, and in particular to modular and/or selectively configurable silencers or noise suppressor that are adjustable.

BACKGROUND

Noise suppressors or silencers for firearms, including rifles and handguns, are well known and have been used for reducing recoil effects, muzzle flash, and the sound signature of a host firearm, and thus offer many advantages to the user. For example, muzzle flashes can be harmful to the user's night vision and can also provide a visual cue as to the location of the person discharging a firearm. Likewise, the sound or report upon firing a firearm also can provide an audible cue to the location of a shooter and further can cause significant harm to the shooter's hearing. Silencers have been developed to substantially reduce these concerns.

There are numerous factors that can affect the performance of a silencer. For example, a silencer with an extended length may contain more baffles than a relatively shorter silencer and thus may be more effective at substantially reducing recoil effects, muzzle flash, and the sound signature of a host firearm. However, such an extended length silencer generally makes the host firearm longer, and, as a consequence, heavier and more cumbersome, than shorter silencers. Therefore, there are situations where a relatively shorter silencer may be preferred or needed over a relatively long silencer, and vice versa.

SUMMARY

An aspect of this disclosure is the provision of a modular silencer or noise suppressor for a firearm, wherein the noise suppressor can be configured by a user so that its length and performance can be conveniently adjusted to match user preferences and/or situational requirements. In one embodiment of this disclosure, such a noise suppressor can comprise a first or rearward section, a second or forward section, and one or more additional sections, such as a third section and/or still other sections, one of which may comprise a front end cap. The rearward section can be configured to be connected to a muzzle end of a barrel of the firearm. The rearward section further can comprise a body defining an interior passage, with at least one baffle positioned at least partially within or along the interior passage of the rearward section. The forward section can comprise a body defining an interior passage, with at least one baffle positioned at least partially with or along the interior passage of the forward section. The connection between the rearward and forward sections can be configured so the interior passage of the rearward section and the interior passage of the forward section are substantially aligned and are open to one another to enable a projectile from the firearm pass therebetween. In one embodiment, the connection between the rearward and forward sections can comprise a threaded connection, whereas the front end cap or other additional section can be screwed into the forward section by way of a threaded connection between the forward section and the front end cap or another additional section, though other releasable connections also can be used.

The front end cap also can be configured to provide a substantially rearwardly directed axial compressive force at least indirectly to the at least one baffle of the forward section as the front end cap is secured thereover. The at least one baffle of the forward section likewise can be configured to engage and apply a substantially rearwardly directed axial compressive force at least indirectly to the at least one baffle of the rearward section. Such compressive forces further can create a substantially axial tension in/along the connection between the rearward and forward sections of the body to help at least partially restrict loosening of the connection between the rearward and forward sections.

In accordance with an embodiment of this disclosure, a series of noise suppressor units, sections, or pieces can be inter-connected to form a modular silencer or suppressor. For example, one or more forward units or sections can be connected between a rearward unit or section and the front end cap, with a compressive connecting force generated therebetween to link the sections or units in series. Thereafter, a method for disassembly of such a modular silencer can include reducing the substantially axial tension created in the connection between the rearward and forward sections of the first noise suppressor, such as by loosening a connection between one or more of the forward sections and/or the front end cap of the first noise suppressor in order to at least partially relieve the substantially rearwardly directed axial compressive force being applied by the forward sections and/or the front end cap to the at least one baffle of the rearwardly adjacent section. Reducing this axial compressive force correspondingly reduces the axial tension in the connection between the rearward and forward section(s), enabling the connection between rearward and forward section(s) to be opened.

Various objects, features and advantages of this disclosure will become apparent to those skilled in the art upon a review of the following detailed description, when taken in conjunction with the accompanying drawings.

Those skilled in the art will appreciate and understand that, according to common practice, the various features of the drawings discussed below are not necessarily drawn to scale, and that the dimensions of various features and elements of the drawings may be expanded or reduced to more clearly illustrate the embodiments of the present disclosure as described herein.

DETAILED DESCRIPTION

Figure 1:
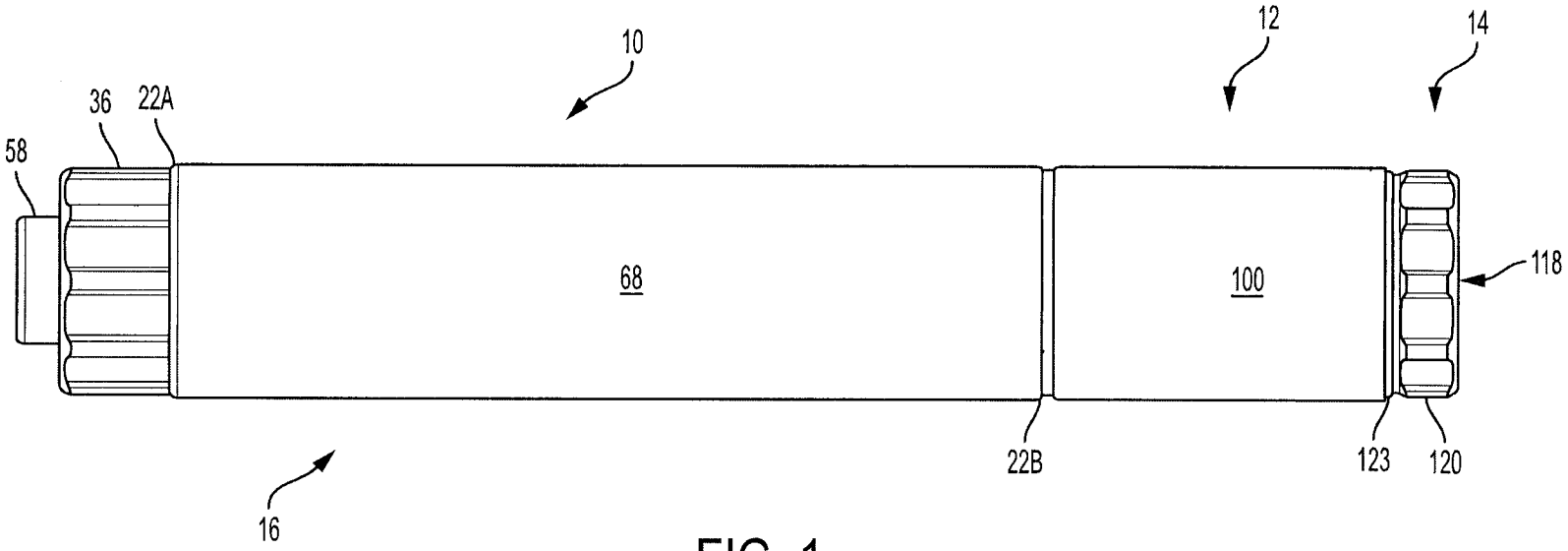
FIG. 1 is illustrative of top, bottom and side views of a long silencer, in accordance with an embodiment of this disclosure.
Figure 2:
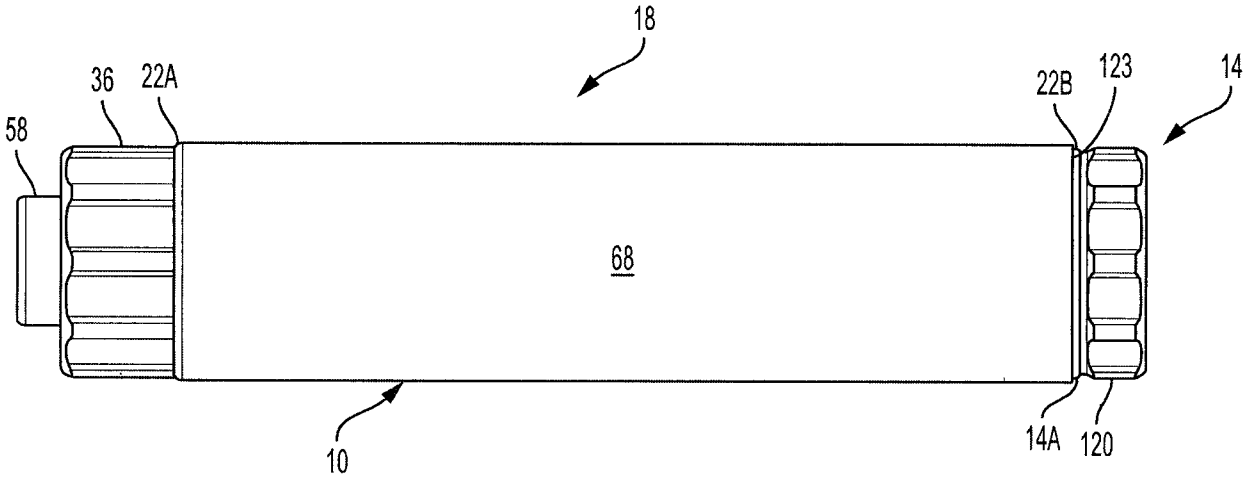
FIG. 2 is illustrative of top, bottom and side views of a short silencer that can be modularly formed by removing an intermediate section or module from the long silencer, in accordance with an embodiment of this disclosure.
Figure 3:
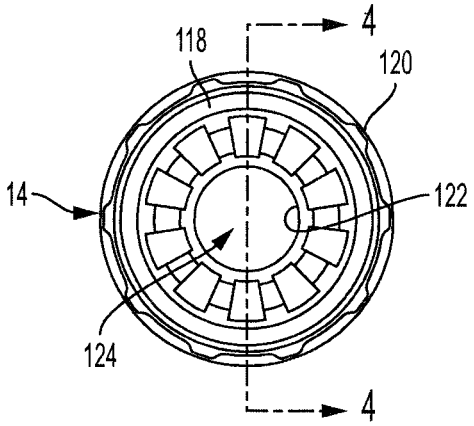
FIG. 3 is an end elevation view of the front end of the long silencer.

Referring now to the drawings, in which like numerals indicate like parts throughout the several views, FIGS. 1-2 illustrate examples of different configurations of a modular silencer or noise suppressor that is adapted for being mounted to the muzzle end of a barrel of a host firearm, in accordance with one or more embodiments of this disclosure. The modular silencer can be adapted so that it may be readily manually reconfigurable between at least a full length or extended configuration 16 shown in FIG. 1, and a compact configuration 18 shown in FIG. 2.

As shown in FIG. 1, the modular silencer 16 includes a modular first or rearward section 10, a modular second or forward section 12, and a modular third and/or other additional sections, which can comprise a front end section or front end cap 14. In the embodiment shown in FIG. 1, the sections 10, 12, 14 may be fixedly connected to one another to form a full length or relatively long noise suppressor or silencer 16. The modular silencer can be reconfigured between the long and short silencers 16, 18 manually without tools, and the long silencer can provide more sound reduction than the short silencer. The forward section 12 may include a selectively removable/includable module that can be used to vary the length and performance of the modular silencer.

Generally described for the embodiment of the long noise suppressor or long silencer 16 shown FIG. 1, the rearward section 10 can contain at least one baffle and be configured to be connected to the muzzle end of the barrel of the firearm, the forward section 12 can contain at least one baffle and be connected to rearward section 10, and the other or front end section 14 can be connected to the forward section 12. The front end section or end cap 14 can be configured to provide a substantially rearwardly directed axial compressive force at least indirectly to the at least one baffle of the forward section 12. The long noise suppressor 16 can be configured so that at least the connection between the rearward and forward sections 10, 12 is in substantially axial tension at least in response to the front end section 14 providing the substantially rearwardly directed axial compressive force to the at least one baffle of the forward section 12. Any loosening of the connection between the rearward and forward sections 10, 12 can be at least partially restricted in response to the axial tension in the connection between the rearward and forward sections 10, 12. For allowing opening of the connection between the rearward and forward sections 10, 12, the axial tension in the connection between the rearward and forward sections 10, 12 can be released, for example, by opening the connection between the forward section 12 and the front end section or end cap 14.

As shown in FIG. 2, the forward section 12 (FIG. 1) has been removed, and the rear and front end sections 10, 14 are fixedly connected to one another to form a compact or relatively short noise suppressor or silencer 18, in accordance with an example embodiment of this disclosure. With the end cap 14 connected to the first or rearward section 10, at least a portion of the end cap 14, such as its rear end 14A, can engage and apply a substantially rearwardly directed axial compressive force to at least one baffle of the rearward section, which compressive force may in turn be transmitted to a series of baffles with the rearward section so as to create an axial tension sufficient to at least partially restrict loosening of the connection between the rearward section 10 and the end cap 14.

Figure 4:
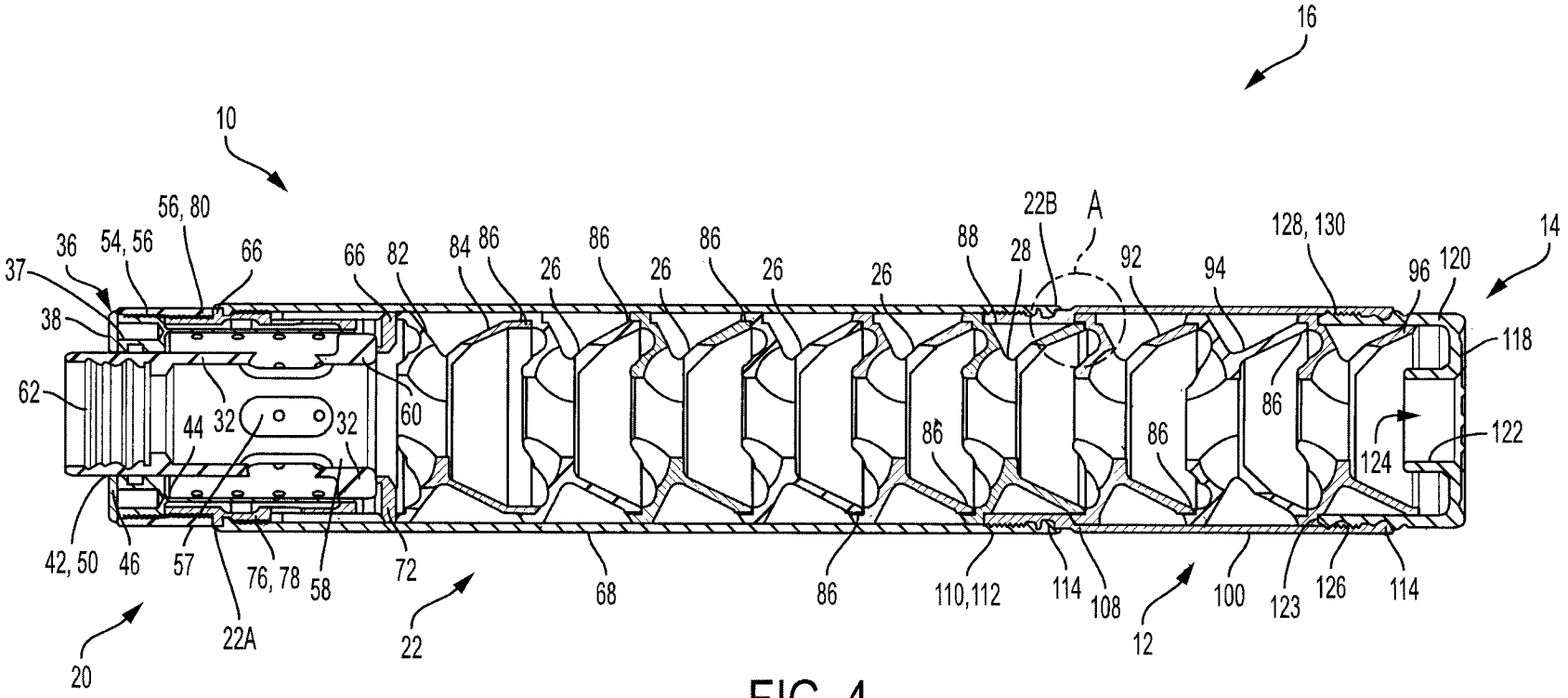
FIG. 4 is a cross-sectional view of the long silencer taken along line 4-4 of FIG. 4.
Figure 5:
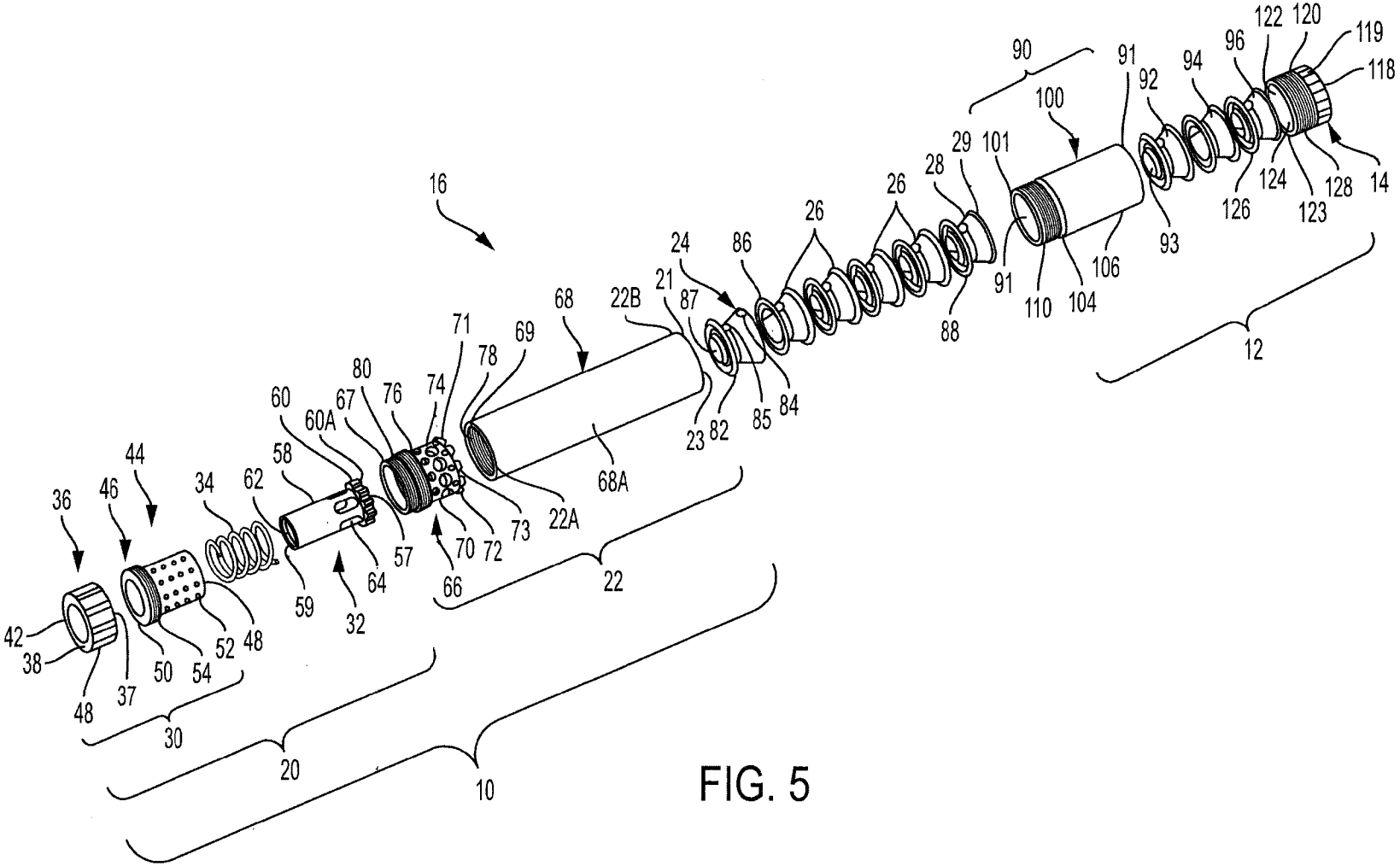
FIG. 5 is an exploded perspective view of the long silencer.

Referring to FIGS. 4-5, the first or rearward section 10 can include a mount apparatus 20 and an elongate rear body 22 connected to the mount apparatus at its rearward or distal end 22A. The mount apparatus 20 can be configured for being connected to the muzzle end of the barrel of the host firearm. The rear body 22 can define an elongate interior passage 23 at least partially housing or containing one or more baffles, such a series of baffles 24, 26, 28, and can be releasably connected to the forward or second section 12 or the front or end cap 14 at its proximal end.

The mount apparatus 20 can be any suitable mount apparatus configured for being used with various types of firearms, including, but not limited to, rifles and other types of long guns, as well as various types of pistols or handguns. For example, in one embodiment not shown in the drawings of the present disclosure, the mount apparatus 20 can consist of a rear end cap of the rearward section 10 that is connected directly to the rear body 22, without the rear end cap including or being associated with any recoil booster, "Nielson device," "Assured Semi Automatic Performance System," or the like.

In the embodiment shown in the drawings, the mount apparatus 20 can comprise or be configured as a recoil booster, "Nielson device," "Assured Semi Automatic Performance System," or the like. As best understood with reference to FIG. 5, such a mount apparatus 20 can include a rear housing 30, piston 32 and compression spring 34. The rear housing 30 can include a rear end cap 36 having a generally flat ring plate or annular cap base 38, and a generally cylindrical cap sidewall 48. The cap sidewall 48 can extend forwardly from the outer periphery of the cap base 38, and a cap hole 42 can be defined by and encircled by the inner periphery of the cap base 38.

The rear housing 30 can further include a guide 44 configured for allowing the piston 32 to reciprocate therein in a predetermined manner at least partially under the control of the spring 34. The guide 44 can include a generally annular guide base 46 and a generally cylindrical guide sidewall 48 that can be integrally formed with one another. The guide sidewall 48 can extend forwardly from the outer periphery of the guide base 46, and a guide hole 50 can be defined by and encircled by the inner periphery of the guide base 46. A series of vent holes 52 can extend through the guide sidewall 48.

In the embodiment shown in FIGS. 4-5, the holes 42, 50 of the cap base 38 and guide base 46 can be substantially coaxially configured or otherwise cooperate to together form a hole 42, 50 in the rear housing 30. The rear housing 30 can be assembled by fixedly mounting the guide base 46 at least partially within a main cavity 37 of the rear end cap 36. The mounting or fixed connection between the guide 44 and the rear end cap 36 can be at least partially facilitated by at least one external helical thread 54 of the guide base 46 being engaged with at least one internal helical thread 56 of the cap sidewall 40, and the threads 54, 56 being cooperatively configured for causing relative axial movement between the rear end cap 36 and the guide 44 in response to relative rotation therebetween. This threaded connection 54, 56 between the rear end cap 36 and the guide 44 may be made substantially permanent by including adhesive material at the threaded connection 54, 56. Alternatively, the connection between the rear end cap 36 and the guide 44 may be provided in any other suitable manner.

As schematically illustrated in FIG. 5, the piston 32 can include a substantially cylindrical wall or at least partially hollow shaft 58, and a head or radially outwardly extending piston flange 60 that are typically integrally formed with one another. The outer periphery of the piston flange 60 can include a series of holes, radiused cut-outs 60A, or the like. The rearward region 62 of the piston shaft 58 can be internally threaded so as to be configured for mating with external threads of the muzzle end of the barrel of the host firearm for mounting purposes. The inner surface 57 of the piston shaft 58 extends around and defines a projectile passageway configured for allowing a projectile from the host firearm to pass therethrough. A series of vent holes 64 can typically extend through the cylindrical wall or shaft 58 of the piston 32. The mount apparatus 20 can be assembled by placing the spring 34 around the piston shaft 58, and inserting the rear end 69 of the piston shaft through the hole 42, 50 in the rear housing 30. Accordingly, upon firing of the host firearm, as or after a projectile passes through the projectile passageway, combustion gases may force or urge the piston 32 in the rearward direction, thereby compressing spring 34, and at least partially absorbing, reducing or otherwise redirecting the recoil force generated during firing.

The rear body 22 of the rearward section 10 of the long silencer 16 can have a substantially cylindrical construction, although other constructions, such as rectangular, elliptical, nonsymmetrical, or the like, also can be used in accordance with the embodiments of this disclosure. For example, as shown in FIG. 5, the rear body 22 can include a generally cylindrical, tubular interface member 66 mounted to a substantially cylindrical sidewall or rear tube 68, and the rear end 67 of the interface member 66 can extend rearwardly out of the rear end 69 of the rear tube 68. The interface member 66 can include a generally cylindrical interface sidewall 70, and an interface flange 72 extending radially inwardly and outwardly from the front end 71 of the interface sidewall 70. The outer periphery of the interface flange 72 can include a series of holes 73, radiused cut-outs, or the like, and a series of vent holes 74 typically can extend through the interface sidewall 70. The rear tube 68 can be constructed of metal, such as titanium, and the outer surface 68A of the rear tube 68 can bear a data panel, such as a data panel including information that may be mandated by law. Similarly, other components of the modular silencers 16, 18 can be made of metal, or any other suitable materials.

The body 22 of the rearward section 10 can be assembled by fixedly mounting the interface member 66 at least partially in the rear tube 68. The mounting or fixed connection between the interface sidewall 70 and the rear tube 68 can be at least partially facilitated by at least one external helical thread 76 of the interface sidewall 70 being engaged with at least one internal helical thread 78 of the rear tube 68, with the threads 76, 78 being cooperatively configured for causing relative axial movement between the interface member 66 and the rear tube 68 in response to relative rotation therebetween. This threaded connection 76, 78 between the interface member 66 and the rear tube 68 may be made substantially permanent by including adhesive material at the threaded connection 76, 78. The connection 76, 78 between the interface member 66 and the rear tube 68, like at least some of the other suitable connections in the long silencer 16, can include O-rings and/or other suitable features for sealing. However, embodiments of this disclosure are not limited to this configuration, and the connection between the interface member 66 and the rear tube 68 may be provided in any other suitable manner.

With embodiments of the present disclosure, when connecting the mount apparatus 20 and the rear body 22 to one another, the front end of the mount apparatus 20 can be introduced into the rear end 22A of the interior passage 23 defined by the rear body 22. The mounting or connection between the mount apparatus 20 and rear body 22 can be facilitated by at least one external helical thread 80 of the interface sidewall 70 being engaged with the internal helical thread 56 of the cap sidewall 40, and the threads 56, 80 being cooperatively configured for causing relative axial movement between the mount apparatus 20 and rear body 22 in response to relative rotation therebetween. Alternatively, the connection 56, 80 between the mount apparatus 20 and rear body 22 may be provided in any other suitable manner. When the rearward section 10 is assembled as shown in FIG. 4, the forward end of the piston 32 can be in substantially abutting contact with a rear face of the interface flange 72.

The baffles 24, 26, 28 of the rearward section 10 can be any suitable silencer baffles that may be arranged in series and may optionally have spacers therebetween and/or at the ends of the series. In one example embodiment, the rear baffle 24 can include a base 82, which can be generally plate-shaped, and a cone 84 extending forwardly from the base 82, wherein the cone 84 may be generally or substantially conical, frustoconical, or in any other suitable shape. Similarly, each of the intermediate and front baffles 26, 28 can generally include a cone 84 extending forwardly from a base 82. Each of the baffles 24, 26, 28 typically includes a central projectile passageway 87 configured for allowing a projectile from the host firearm to pass therethrough, and each of the baffles 24, 26, 28 typically further includes one or more exhaust ports 85.

The maximal outer diameters of the baffles 24, 26, 28 typically will be slightly smaller than the inner diameter of the rear tube 68, so that baffles 24, 26, 28 can be slid into the front end 21 of the interior passage 23 defined by the rear body 22. In one example of a suitable method for installing the stack of baffles 24, 26, 28 in the interior passage 23 of the rear body 22, the front baffle 28 can be placed on a level surface so that the cone of the front baffle is facing down. Then, a first intermediate baffle 26 with its cone facing down can be stacked on top of the base of the front baffle 28, a second intermediate baffle 26 with its cone facing down can be stacked on top of the base of the first intermediate baffle 26, a third intermediate baffle 26 with its cone facing down can be stacked on top of the base of the second intermediate baffle 26, a fourth intermediate baffle 26 with its cone facing down can be stacked on top of the base of the third intermediate baffle 26, and a blast or rear baffle 24 with its cone facing down can be stacked on top of the base of the fourth intermediate baffle 26. Then, a forward end of the rear body 22 or rear tube 68 may be lowered over the stack of baffles 24, 26, 28 so that the stack slides into the interior passage 23 defined by the rear body 22.

As shown in FIG. 4, the annular rear end of the rear baffle 24 can be in abutting contact with a forward face of the interface flange 72. As also shown in FIG. 4, for each of the intermediate and front baffles 26, 28, its annular rear end can include an annular rear baffle shoulder 86 that partially defines an annular recess that can be in receipt of the annular forward end of the rearwardly adjacent baffle, so that the annular forward end of the rearwardly adjacent baffle is in abutting contact with the rear baffle shoulder 86. The front baffle 28 can also include an annular front baffle shoulder 88.

Figure 6:
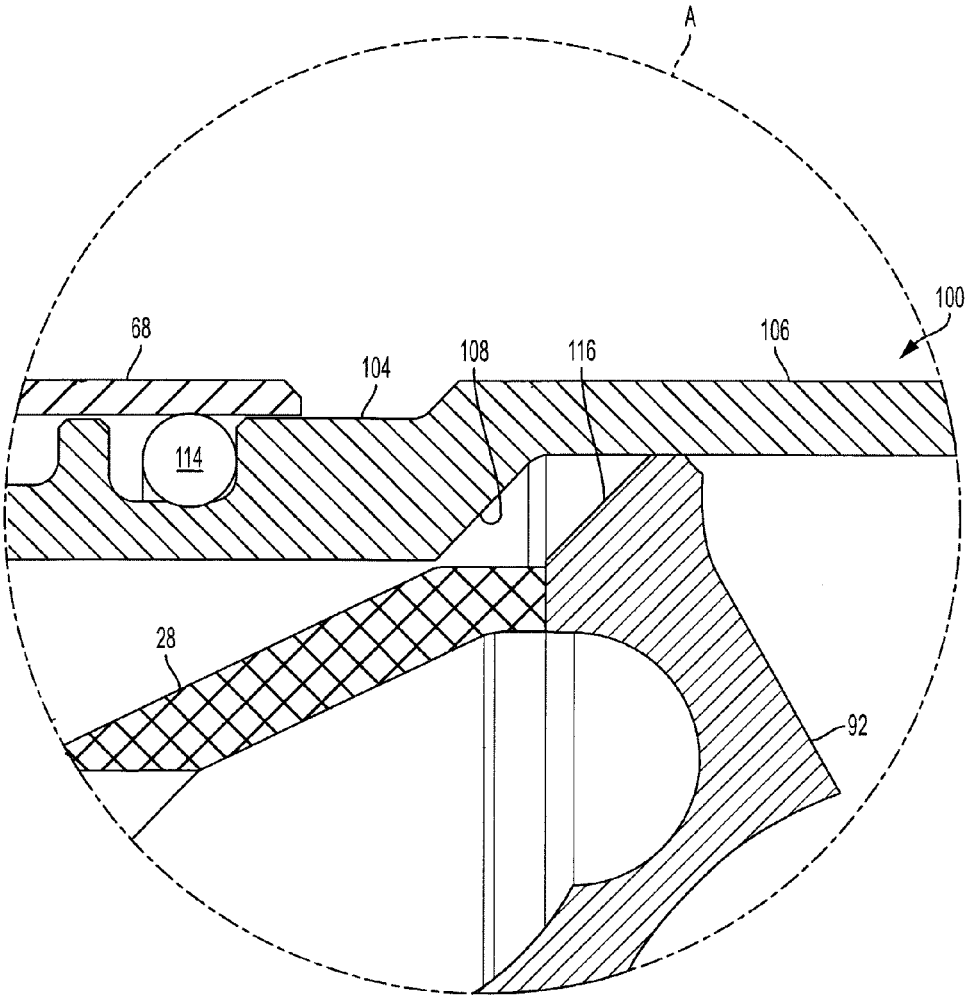
FIG. 6 is an enlarged view of the portion of FIG. 4 identified by the circle designated as detail A in FIG. 4.
Figure 7:
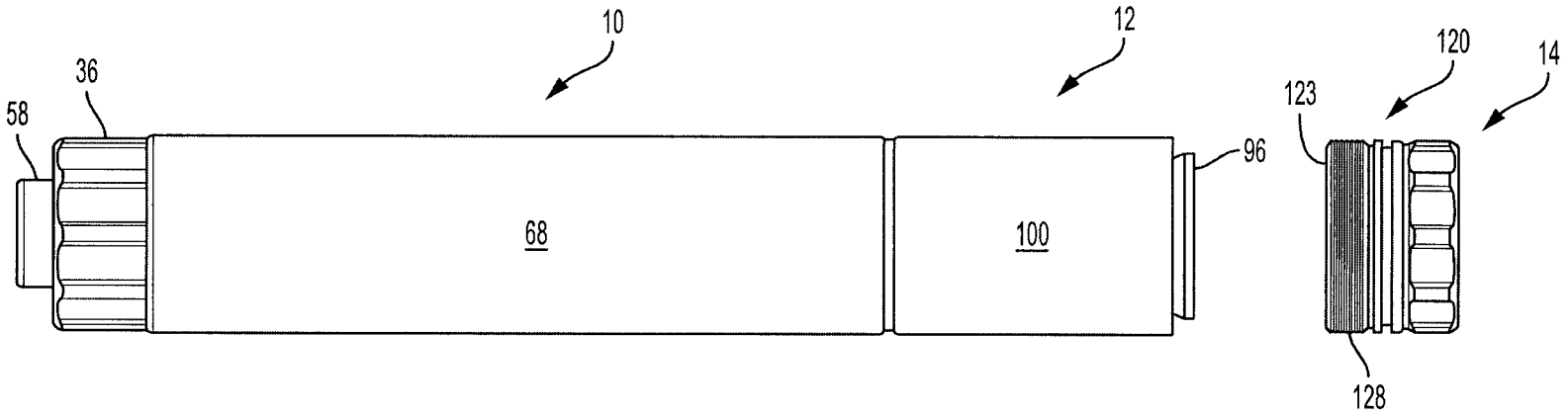
FIGS. 7 and 8 are views of the long silencer with a front end cap thereof exploded away from a remainder of the long silencer.
Figure 8:
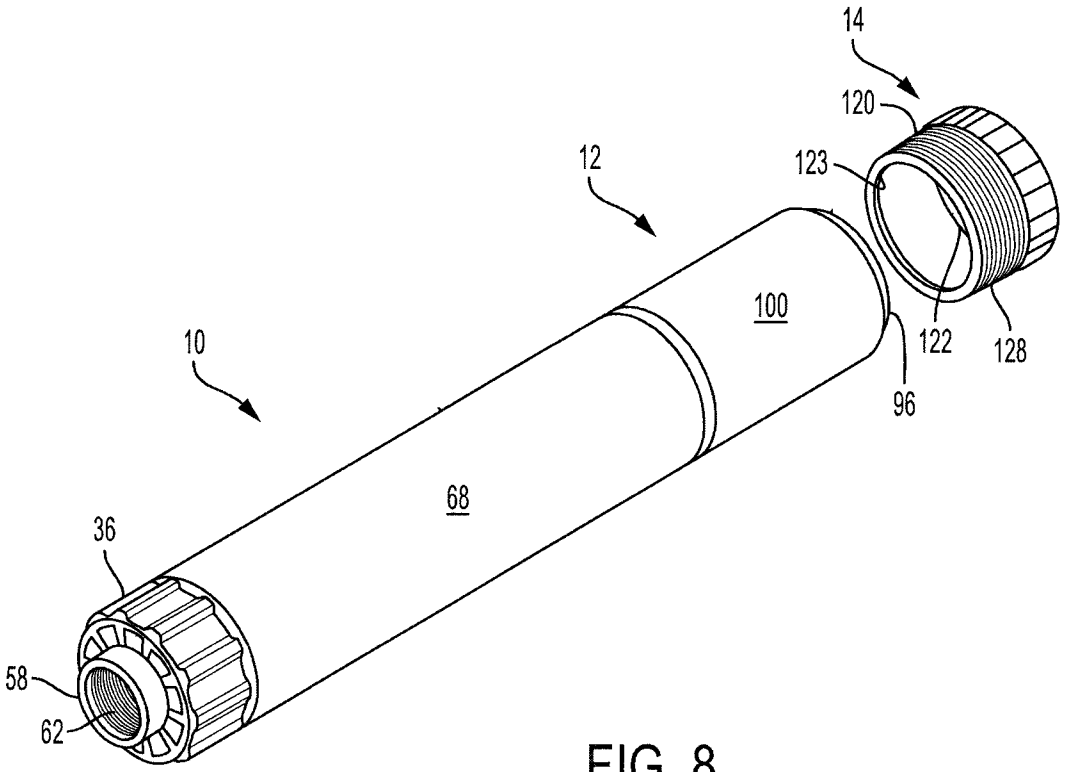
Figure 9:
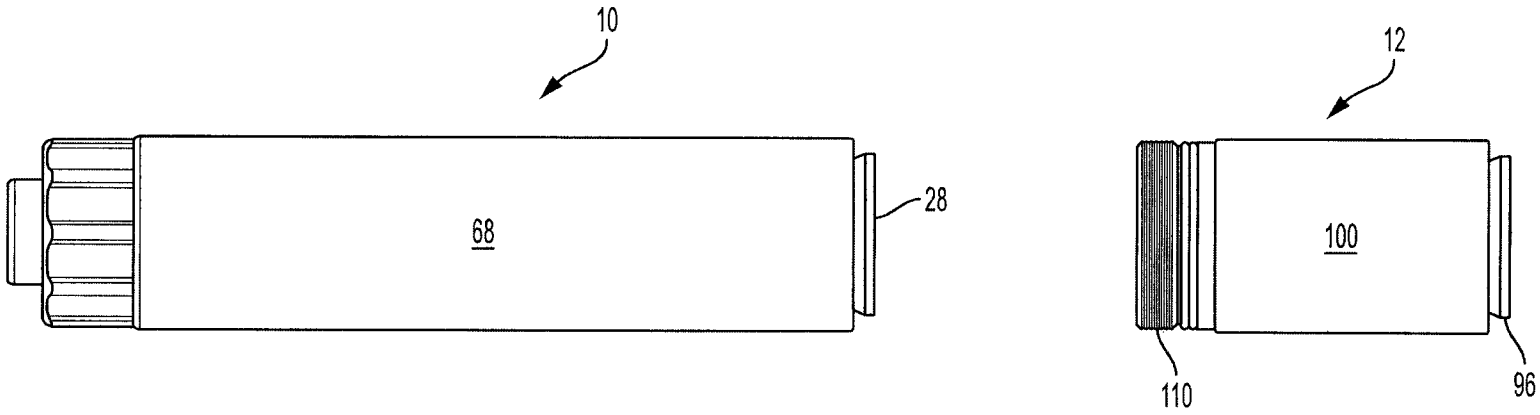
FIGS. 9 and 10 illustrate rearward and forward sections of the long silencer exploded away from each other.
Figure 10:
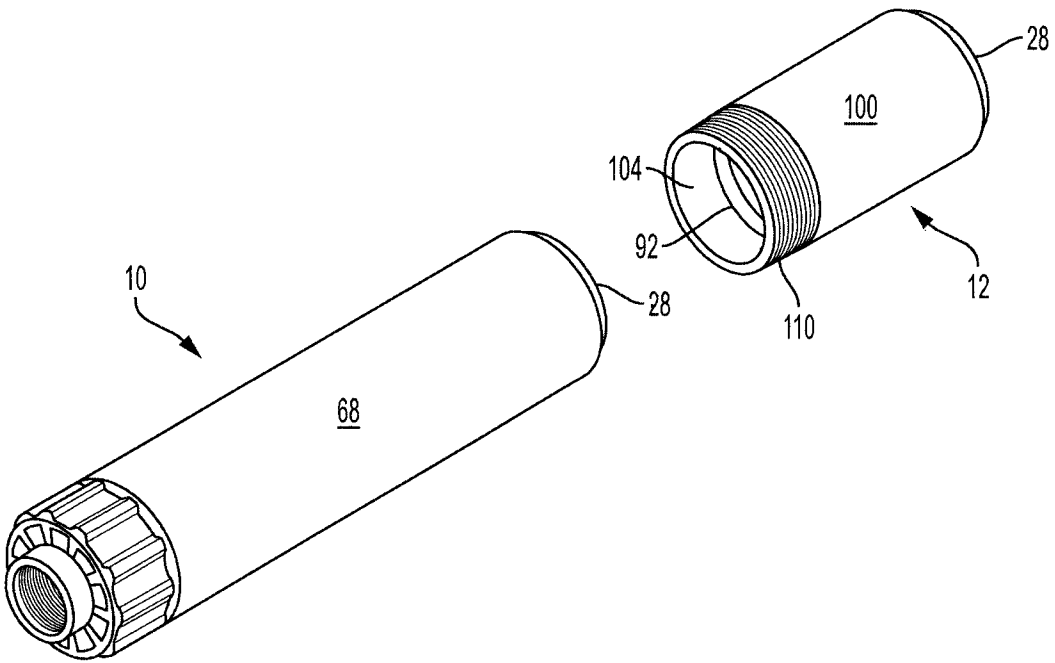

Referring again to FIGS. 4-5, the second or forward section 12 of the long silencer 16 can include an elongate front body 90 defining an elongate interior passage 91 containing one or more baffles, such as a series of baffles 92, 94, 96. The front body 90 can have a substantially cylindrical construction, although other constructions, such as rectangular, elliptical, nonsymmetrical, or the like, also can be used. In addition, the front body 90 can comprise a substantially cylindrical sidewall or front tube 100 having rear and front sections 104, 106 (FIG. 5). Referring to FIG. 6, the rear section 104 has a smaller diameter than the front section 106 so that an annular, internal restriction or tube shoulder 108 is positioned in the interior passage of the forward section 12. The front tube 100 can be constructed of metal, such as anodized aluminum.

In one embodiment, a composite outer tube of a long or extended configuration silencer 16 is comprised of the rear and front tubes 68, 100, and the multi-piece composite outer tube 68, 100 can be assembled after the baffles 24, 26, 28 are installed in the interior passage of the rearward section 10 and before the baffles 92, 94, 96 are installed in the interior passage of the forward section 12. As a step in connecting the rear and front tubes 68, 100 to one another, the rear end of the front tube 100 can be introduced into the front end of the interior passage of the rear tube 68. The mounting or connection between the tubes 68, 100 can be facilitated by at least one external helical thread 110 of the front tube 100 being engaged with at least one internal helical thread 112 of the rear tube 68, and the threads 110, 112 being cooperatively configured for causing relative axial movement between the tubes 68, 100 in response to relative rotation therebetween. The connection 110, 112 between the tubes 68, 100 can include at least one O-ring 114 and/or other suitable features for sealing. Alternatively, the connection between the tubes 68, 100 may be provided in any other suitable manner.

In one embodiment, when the rear end 101 of the front tube 100 travels farther into the interior passage of the rear tube 68, such as in response to the front tube 100 being screwed farther into the rear tube 68 by way of the connection 110, 112, the annular rear end of the front tube 100 can come into abutting contact with the annular front baffle shoulder 88 of the front baffle 28. At least partially as a result, the baffles 24, 26, 28 can be encapsulated in the rearward section 10, and, optionally, the front tube 100 can provide a substantially rearwardly directed axial compressive force to the front baffle 28. The baffles 24, 26, 28 can be configured to serially pass on the rearwardly directed axial compressive force to the interface member 66, and at least partially as a result, the front tube 100 can provide a tensile force to proximate the front end of the rear tube 68 by way of the connection 110, 112, and the interface member 66 can provide a tensile force to proximate the rear end of the rear tube 68 by way of the connection 76, 78, with these tensile forces extending in substantially opposite axial directions to cause at least a portion of the rear body 22 and rear tube 68 to be in substantially axial tension. Additionally, embodiments of the present disclosure may include one or more intermediate sections or portions, such as one or more additional tubes or other suitable portions, which may be removably connectible to the front and rear tubes 110/112, to enable additional extended or other configurations of the silencer.

The baffles 92, 94, 96 of the forward section 12 can be any suitable silencer baffles that may be arranged in series and may optionally have spacers therebetween and/or at the ends of the series. Generally, similarly to the rear baffle 24, each of the baffles 92, 94, 96 can include a cone extending forwardly from a base. Each of the baffles 92, 94, 96 typically includes a central projectile passageway configured for having a projectile from the host firearm pass therethrough, and each of the baffles typically further includes one or more exhaust ports.

The maximal outer diameters of the baffles 92, 94, 96 typically will be slightly smaller than the inner diameter of the front section 106 of the front tube 100, so that the baffles 92, 94, 96 can be slid into the front end of the interior passage defined by the front body 90 or tube 100. In contrast, the maximal outer diameters of the baffles 92, 94, 96 can be larger than the inner diameter of the rear section 104 of the front tube 100, so that when the tubes 68, 100 are not connected to one another, the oblique tube shoulder 108 (FIG. 6) can engage an oblique shoulder 116 (FIG. 6) of the rear baffle 92 to arrest forward movement of the rear baffle 92 to prevent the baffles 92, 94, 96 from traveling into the rear section 104 of the front tube 100 and falling out of the rear end of the front tube 100.

In one example of a suitable method for installing the stack of baffles 92, 94, 96 in the interior passage of the front body 90, the front baffle 96 can be placed on a substantially level surface so that the cone of the front baffle 96 is facing down. Then, the intermediate baffle 94 with its cone facing down can be stacked on top of the base of the front baffle 96, and the rear baffle 92 with its cone facing down can be stacked on top of the base of the intermediate baffle 94. Then, the forward end of the front body 90 may be lowered over the stack of baffles 92, 94, 96 so that the stack slides into the interior passage defined by the front body 90.

With reference to FIGS. 4 and 6, the annular rear end 93 of the rear baffle 92 can be in abutting contact with an annular forward face 29 of the front baffle 28, and as also shown in FIG. 4, for each of the intermediate and front baffles 94, 96, its annular rear end can include an annular rear baffle shoulder 86 that partially defines an annular recess that can be in receipt of the annular forward end of the rearwardly adjacent baffle so that the annular forward end of the rearwardly adjacent baffle is in abutting contact with the rear baffle shoulder 86. The front baffle 96 can also include an annular front baffle shoulder 126.

The baffles 92, 94, 96 can be closed in the interior passage defined by the front body 90 by a suitable structure that may be a front end section, a centrally open plug, or the front end cap 14. The front end cap 14 can comprise a body have a generally flat ring plate or annular cap base 118 defining a front end 119, a generally cylindrical outer sidewall 120, and a generally cylindrical inner sidewall 122, all of which can be integrally formed with one another. The cap sidewalls 120, 122 can extend rearwardly respectively from the outer and inner periphery of the cap base 118 and terminating at a rear or distal end 123 of the end cap 14. A cap interior passage 124, which is configured for having the projectile from the host firearm pass therethrough, can be defined by and encircled by the inner sidewall 122 and the inner peripheral portion of the cap base 118.

When connecting the forward section 12 and front end cap 14 to one another, the rear end of the front end cap 14 can be introduced into the front end of the interior passage of the front tube 100 or forward section 12. The mounting or connection between the forward section 12 and front end cap 14 can be facilitated by at least one external helical thread 128 of the outer sidewall 120 of the front end cap being engaged with at least one internal helical thread 130 of the front tube 100, and the threads 128, 130 being cooperatively configured for causing relative axial movement between the forward section 12 and front end cap 14 in response to relative rotation therebetween. The connection 128, 130 between the forward section 12 and front end cap 14 can include at least one O-ring 114 and/or other suitable features for sealing. Alternatively, the connection between the forward section 12 and front end cap 14 may be provided in any other suitable manner.

In one embodiment, when the rear end 123 of the front end cap 14 travels farther into the interior passage of the rear tube 68 or forward section 12, such as in response to the front end cap 14 being screwed farther into the rear tube 68 by way of the connection 128, 130, the annular rear end 123 of the front end cap 14 can come into abutting contact with the annular front baffle shoulder 126 of the front baffle 96. At least partially as a result, the baffles 92, 94, 96 can be encapsulated in the forward section 12, and the front end cap 14 can provide a substantially rearwardly directed axial compressive force to the front baffle 96. The baffles 24, 26, 28, 92, 94, 96 can be configured to serially pass on the rearwardly directed axial compressive force to the interface member 66. At least partially as a result, the front end cap 14 can provide a tensile force to proximate the front end of the front tube 100 by way of the connection 128, 130, and the interface member 66 can provide a tensile force to proximate the rear end of the rear tube 68 by way of the connection 76, 78, wherein these tensile forces extend in substantially opposite axial directions to cause at least the portions of the tubes 68, 100 that include the threads 110, 112 to be in substantially axial tension (e.g., there can be substantially axial tension in the connection 110, 112) in a manner that seeks to restrict any loosening of the connection 110, 112. The substantially axial tension in the connection 110, 112 seeks to minimize any potential for the connection 110, 112 to become unintentionally loosened (e.g., unthreaded) during use of the long silencer 16.

In accordance with a method of an example embodiment of this disclosure, respective portions of the long silencer 16 (FIGS. 1 and 4) can be adjusted or reconfigured to provide the short silencer 16 (FIG. 2), such as by removing the forward section 12 and fixedly connecting the rear section 10 and the front end section or front end cap 14 to one another. The removing of the forward section 12 from the long silencer 16 can include first reducing the substantially axial tension in the connection 110, 112 between the rearward and forward sections 10, 12, such as by loosening (e.g., opening) the connection 128, 130 between the forward section 12 and the front end section or cap 14, and then loosening (e.g., opening) the connection 110, 112. For example, FIGS. 7-10 illustrate that the front end cap 14 can be removed from the forward section 12 prior to separating the rearward and forward sections 10, 12 from one another. When the forward section 12 is separated from the rearward section 10, the oblique tube shoulder 108 (FIG. 6) of the forward section 12 can engage an oblique shoulder 116 (FIG. 6) of the rear baffle 92 to arrest forward movement of the rear baffle 92 to prevent the baffles 92, 94, 96 from falling out of the rear end of the forward section 12.

After the sections 10, 12, 14 of the long silencer 16 have been separated from one another, the short silencer 18 (FIG. 2) can be assembled by connecting the rearward section 10 and the front section or end cap 14 to one another. As a step in connecting the rearward section 10 and front end cap 14 to one another, the rear end 123 of the front end cap 14 can be introduced into the front end of the interior passage of the rear tube 68 or rearward section 10. The mounting or connection between the rearward section 10 and front end cap 14 can be facilitated by at the least one external helical thread 128 of the front end cap 14 being engaged with the at least one internal helical thread 112 of the rear tube 68, and the threads 112, 128 being cooperatively configured for causing relative axial movement between the rearward section 10 and front end cap 14 in response to relative rotation therebetween. The connection 112, 128 between the rearward section 10 and front end cap 14 can include at least one O-ring 114 and/or other suitable features for sealing. Alternatively, the connection between the rearward section 10 and front end cap 14 may be provided in any other suitable manner.

In one embodiment, as the rear end 123 of the front end cap 14 travels farther into the interior passage of the rear tube 68 or rearward section 10, such as in response to the front end cap 14 being screwed farther into the rear tube 68 by way of the connection 112, 128, the annular rear end of the front end cap 14 can come into abutting contact with the annular front baffle shoulder 88 of the front baffle 28. At least partially as a result, the baffles 24, 26, 28 can be encapsulated in the rearward section 10, and the front end cap 14 can optionally provide a substantially rearwardly directed axial compressive force to the front baffle 28. The baffles 24, 26, 28 can be configured to serially pass on the rearwardly directed axial compressive force to the interface member 66. At least partially as a result, the front end cap 14 can provide a tensile force to proximate the front end of the rear tube 68 by way of the connection 112, 128, and the interface member 66 can provide a tensile force to proximate the rear end of the rear tube 68 by way of the connection 76, 78, wherein these tensile forces extend in substantially opposite axial directions to cause at least a portion of the rear tube 68 to be in substantially axial tension.

A wide variety of variations are within the scope of this disclosure. For example, the rearward and forward sections 10, 12 can include different numbers of the baffles 24, 26, 28, 92, 94, 96, and baffles configured differently than discussed above are within the scope of this disclosure. Also, a variety of different configurations of the modular silencers are within the scope of this disclosure. For example, in one embodiment, a first forward section 12 can be mounted to the front end of a rear section 10, a second forward section 12 can be mounted to the front end of the first forward section 12, and a front end cap 14 can be mounted to the front end of the second forward section 12. Such serial connections of forward sections 12 can include any suitable number of forward sections 12.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

The invention claimed is:

1. A modular noise suppressor for a firearm, comprising:

a first section including a mount configured for connection to the firearm, a body attached to the mount and defining an interior passage extending therealong, and at least one baffle received within the interior passage of the body;

a second section including an elongate body defining an interior passage with at least one additional baffle positioned therewithin, the second section configured to be removably connected to the first section such that the interior passages of the first section and second section are substantially aligned with one another, wherein other elongate bodies of different lengths can be substituted for the elongated body to enable reconfiguration of the noise suppressor to form extended and compact configurations of the noise suppressor; and an end cap mountable to a front end of the second section and configured to apply an axial compressive force directed against the at least one additional baffle of the second section as the end cap is mounted to the front end thereof, wherein the axial compressive force is communicated through the at least one additional baffle of the second section to the first section so as to prevent relative movement between the first and second sections.

2. The modular noise suppressor according to claim 1, wherein the axial compressive force directed against the at least one additional baffle of the second section generates an axial tension force between at least a portion of the body of the first section and at least a portion of the body of the second section sufficient to substantially restrict disengagement of the connection between the first section and the second section.

3. The modular noise suppressor of claim 1, wherein the connection between the first section and the second section comprises a threaded connection.

4. The modular noise suppressor of claim 1, further comprising at least one intermediate section connected to the first and/or second section, the at least one intermediate section including at least one baffle.

5. The modular noise suppressor of claim 1, wherein the second section comprises a front tube, the first section comprises a rear tube, and the front tube has a rear end configured to be at least partially received within an interior passage of the rear tube.

6. The modular noise suppressor of claim 5, wherein the rear tube at least partially encapsulates a series of baffles, and the front tube provides a rearwardly directed compressive force on a foremost baffle of the series of baffles so as to serially pass the compressive force on the foremost baffle through others of the series of baffles and apply a tensile force to the rear tube.

7. The modular noise suppressor of claim 6, wherein each of the series of baffles comprises a baffle body including a base, a cone extending from the base, a passage allowing a projectile to pass therethrough, and at least one exhaust port defined therein, and wherein the series of baffles are arranged such that cones of the series of baffle are in an abutting relationship with bases of adjacent baffles.

8. The modular noise suppressor of claim 1, wherein the mount of the first section comprises a recoil booster configured to at least partially reduce, absorb and/or redirect a recoil force of the firearm.

9. A method of forming a noise suppressor for a firearm, comprising:

connecting a forward section to a rearward section with at least one baffle of the forward section engaging at least one baffle of the rearward section, and with interior passages of the baffles of each of the forward and rearward sections in alignment;

mounting a front end cap to a front end of the forward section, the front end cap comprising a base having a projectile passage therethrough, and a rearwardly projecting side wall dimensioned to be received with the forward section and in engagement with the at least one baffle of the forward section; and as the front end cap is mounted to the front end of the forward section, applying a substantially rearwardly-directed axial compressive force against the at least one baffle of the forward section by engagement of the end cap therewith and against the at least one baffle of the rearward section by the at least one baffle of the forward section, wherein an axial tension is created between the at least one forward section and the rearward section in response to the axial compressive force so as to restrict loosening of the connection therebetween.

10. The method of 9, further comprising loosening a connection between the front end cap and the forward section sufficient to at least partially relieve the rearwardly directed axial compressive force applied by the front end cap to at least one baffle of the forward section and reduce the axial tension in the connection between the rearward and forward sections of the noise suppressor;

disconnecting the rearward and forward sections;

connecting a new forward section to the rearward section to form a different length or configuration suppressor; and resecuring the end cap to the new forward section.

11. The method of claim 9, further comprising connecting multiple additional, intermediate sections in series, between the rearward section and the end cap to define a modular silencer of a user selected length.

* * * * *